US005445388A

United States Patent [19]

Mitchell

[11] Patent Number: 5,445,388

[45] Date of Patent: Aug. 29, 1995

[54] ILLUMINATED PLAYING CARD BOARD GAME APPARATUS

[76] Inventor: William R. Mitchell, 321 Oak Leaf Cir., Lake Mary, Fla. 32746

[21] Appl. No.: 130,688

[22] Filed: Oct. 4, 1993

[51] Int. Cl.[6] ..... A63F 3/00

[52] U.S. Cl. ..... 273/237; 273/287; 273/141 A; 273/142 B

[58] Field of Search ..... 273/237, 274, 280, 287, 273/141 A, 142 B, 138 A, 292, DIG. 14, 460

[56] References Cited

U.S. PATENT DOCUMENTS

| | | | |
|---|---|---|---|
| 3,834,711 | 9/1974 | Breslow | 273/141 A |
| 3,921,982 | 11/1975 | Feldman | 273/274 |
| 4,059,272 | 11/1977 | Pullman | 273/237 |

FOREIGN PATENT DOCUMENTS

| | | | |
|---|---|---|---|
| 68893 | 10/1951 | Netherlands | 273/274 |

OTHER PUBLICATIONS

"Tripoley", Cadaco Catalog, 1970.

*Primary Examiner*—Vincent Millin
*Assistant Examiner*—William M. Pierce

[57] ABSTRACT

A playing board is arranged to include an annular array of first spaces, with a central space, with the organization further including a deck of bridge-type cards, including a joker as well as a number of playing chips to be distributed among the players in an equal quantity. A dealer distributes a plurality of playing hands to each of the players and the players in sequence place chips upon each of the individual first through tenth playing spaces relative to each hand, wherein each hand is initially indicated by a sequential playing of the first through ninth spaces, where subsequently, a game similar to Rummy is played, wherein sequencing of cards is effected and subsequently poker-like hands are played, wherein the object of the game is to finally effect discard of playing cards, with a winner being decided by the first player to discard all cards and thereby obtain all remaining chips within the central space of the game board.

1 Claim, 4 Drawing Sheets

ILLUMINATED PLAYING CARD BOARD GAME APPARATUS

BACKGROUND OF THE INVENTION

1. Field of the Invention

The field of invention relates to game board apparatus, and more particularly pertains to a new and improved playing card board game apparatus wherein the same is directed to the playing of a board game with inter-related playing cards and playing chips.

2. Description of the Prior Art

Game board structure of various types are utilized throughout the prior art, wherein game boards employing various chips and cards is indicated in U.S. Pat. No. 4,359,226, with further examples of such play indicates in U.S. Pat. Nos. 5,064,200 and 4,887,819.

The instant invention attempts to overcome deficiencies of the prior art by employing a board game structure, wherein games of various types are played in sequential form and in this respect, the present invention substantially fulfills this need.

SUMMARY OF THE INVENTION

In view of the foregoing disadvantages inherent in the known types of board game apparatus now present in the prior art, the present invention provides a playing card board game apparatus employing inter-related playing cards and a game board, playing various games in a sequential manner. As such, the general purpose of the present invention, which will be described subsequently in greater detail, is to provide a new and improved playing card board game apparatus which has all the advantages of the prior art board game apparatus and none of the disadvantages.

To attain this, the present invention provides a playing board arranged to include an annular array of first spaces, with a central space, with the organization further including a deck of bridge-type cards, including a joker as well as a number of playing chips to be distributed among the players in an equal quantity. A dealer distibutes a plurality of playing hands to each of the players and the players in sequence place chips upon each of the individual first through tenth playing spaces relative to each hand, wherein each hand is initially indicated by a sequential playing of the first through ninth spaces, where subsequently, a game similar to Rummy is played, wherein sequencing of cards is effected and subsequently poker-like hands are played, wherein the object of the game is to finally effect discard of playing cards, with a winner being decided by the first player to discard all cards and thereby obtain all remaining chips within the central space of the game board.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved playing card board game apparatus which has all the advantages of the prior art board game apparatus and none of the disadvantages.

It is another object of the present invention to provide a new and improved playing card board game apparatus which may be easily and efficiently manufactured and marketed.

It is a further object of the present invention to provide a new and improved playing card board game apparatus which is of a durable and reliable construction.

An even further object of the present invention is to provide a new and improved playing card board game apparatus which is susceptible of a low cost of manufacture with regard to both materials and labor, and which accordingly is then susceptible of low prices of sale to the consuming public, thereby making such playing card board game apparatus economically available to the buying public.

Still yet another object of the present invention is to provide a new and improved playing card board game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
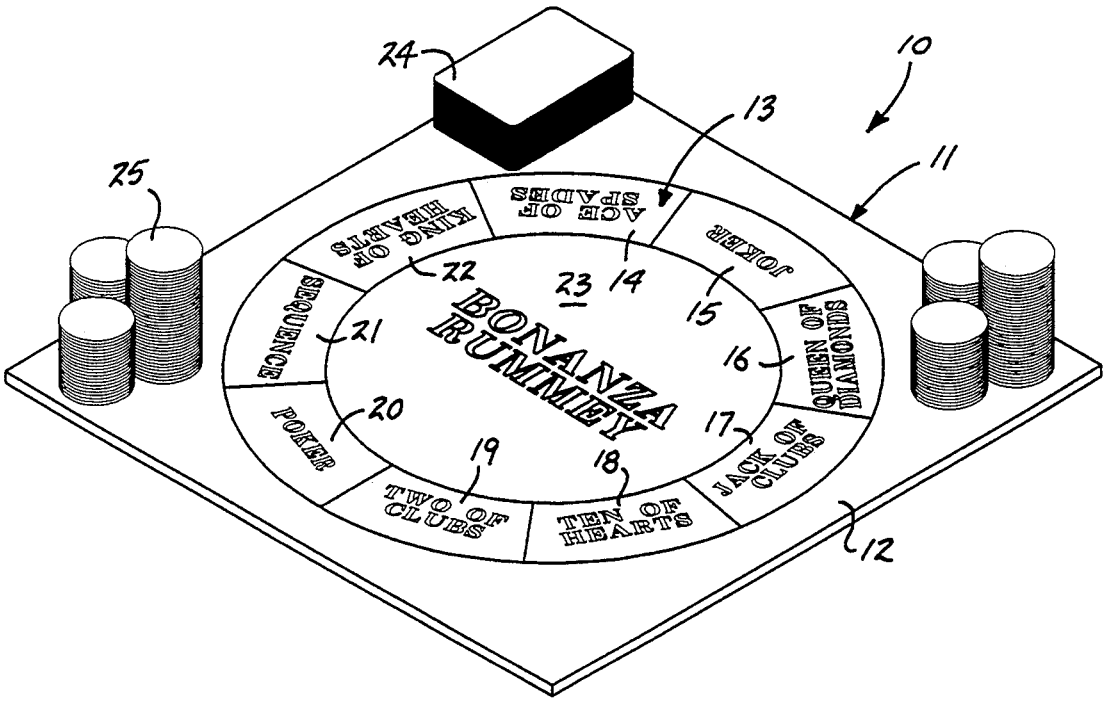
FIG. 1 is an isometric illustration of the apparatus of the invention.
Figure 2:
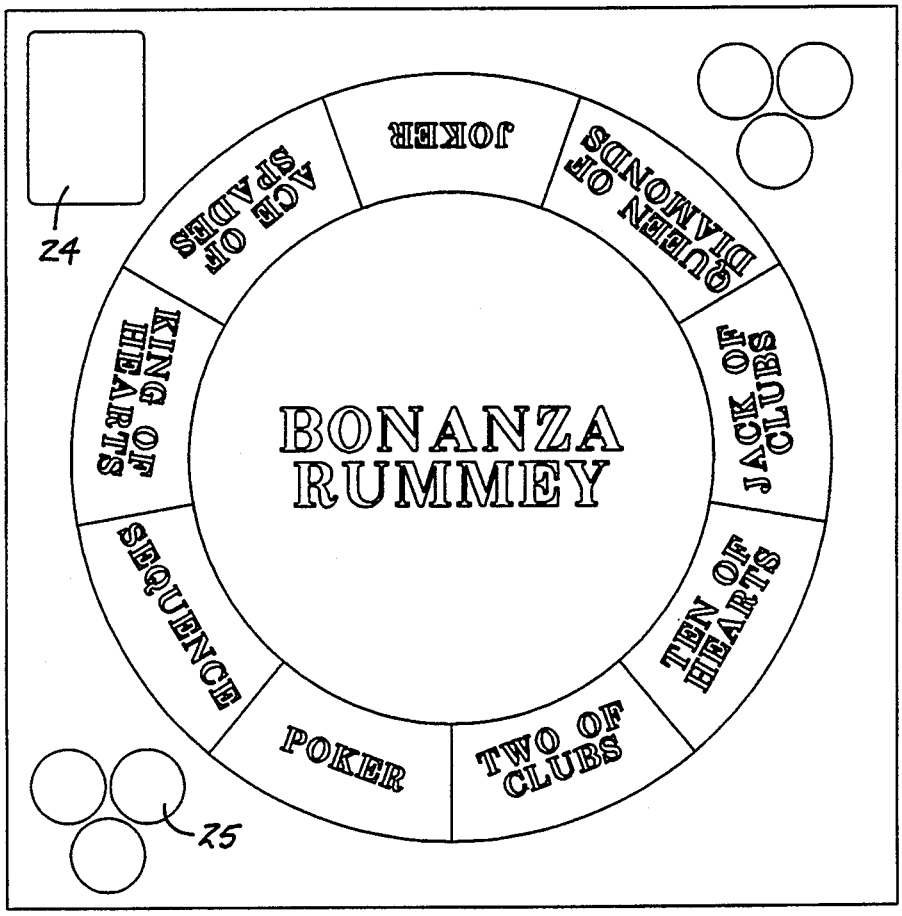
FIG. 2 is an orthographic top view of the game board.

With reference now to the drawings, and in particular to FIGS. 1 to 7 thereof, a new and improved playing card board game apparatus embodying the principles and concepts of the present invention and generally designated by the reference numeral 10 will be described.

More specifically, the playing card board game apparatus 10 of the instant invention essentially comprises a game board 11 having a game board top wall 12, including an annular array of spaces 13, including respective first through ninth playing spaces 11–22 inclusively, with the seventh and eighth playing spaces 20 and 21 indicating the use for the players to play games on a "poker" basis or a "sequence" of the cards, in a manner of playing Rummy and the like, wherein cards in series such as two through five etc. are utilized such that the greater the sequence, i.e. Jack through ace for example, is superior to a lesser sequence, such as two through five. Prior to the dealing of each hand for each respective player, players deposit a predetermined number of playing chips 25 on one of the playing spaces 14–19 and 22, as well as playing space 23. The playing space 23 accumulates tokens or chips until the final winner at the end of the game collects such accumulation of chips, wherein the final hand determines the final individual to obtain the chips accumulated within the tenth playing space 23. A bridge card deck 24 is provided that further includes a "Joker".

A manner of play of the game is such that each player is dealt a plurality of hands, wherein the second hand may be kept or bartered or sold to other players. Initially, in the spaces 14–19 and 22 are announced in sequence and such as the first playing space 14 announces the Ace of spades and a player to have the Ace of spades will remove the chips 25 accumulated upon that first playing space 14 that are deposited initially prior to the dealing of the hands. In this manner, the spaces 14–19 and 22 are thusly played in a sequential manner. Subsequently, further hands are dealt, wherein players employ the use of poker style hands indicating the use of the poker space 20 that accumulates the chips or sequence of cards by the Ace playing space 21. It is understood that the game board may be employed in various other manners, with the foregoing merely an example. Further, it may be desired that the players finally with each hand have accumulated tokens or chips within the tenth space 23, continue to discard cards utilizing for example a lowest card first, wherein the highest and the lowest cards relative to each sequence of play among the players takes the cards, wherein the first person to have discarded all cards is awarded the accumulated chips 25 within the tenth space 23.

Figure 3:
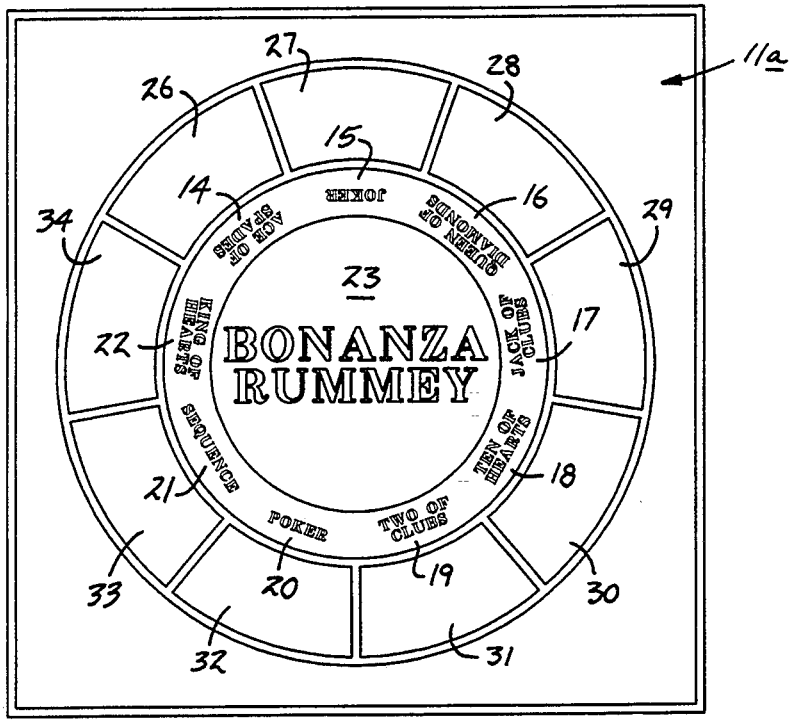
FIG. 3 is an orthographic top view of a modified game board structure.
Figure 4:
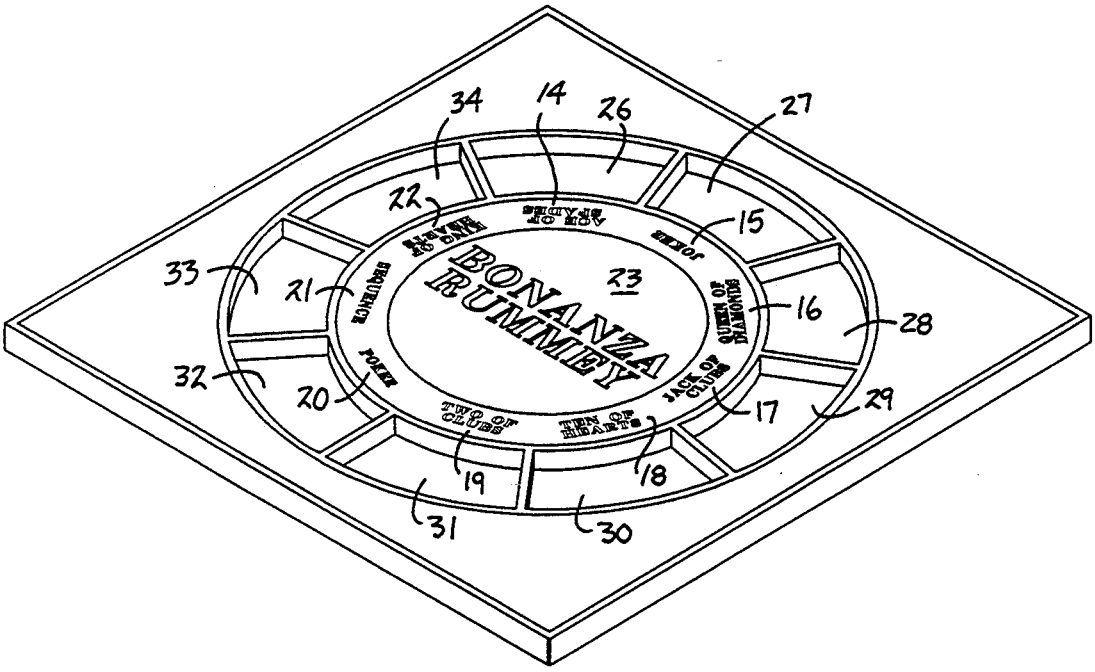
FIG. 4 is an isometric illustration of the modified game board structure.

A modified game board 11*a* is illustrated in the FIGS. 3 and 4, having recessed first through ninth pockets 26–34 inclusively in adjacency to and coextensive with the first through ninth playing spaces 14–22, with the recessed pockets 34 positioned in an annular array exteriorly of the annular array of playing spaces 13. The pockets 26–34 permit the ease of accumulation of chips within such pockets.

Figure 5:
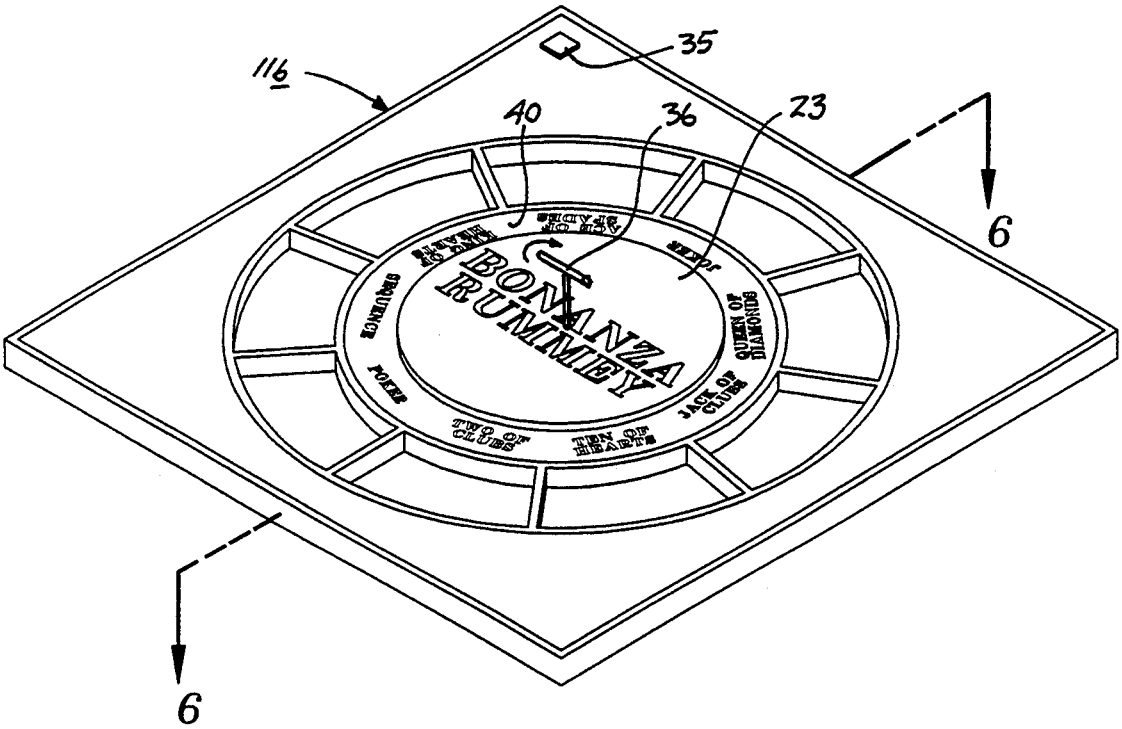
FIG. 5 is an isometric illustration of a further modified game board structure.
Figure 6:
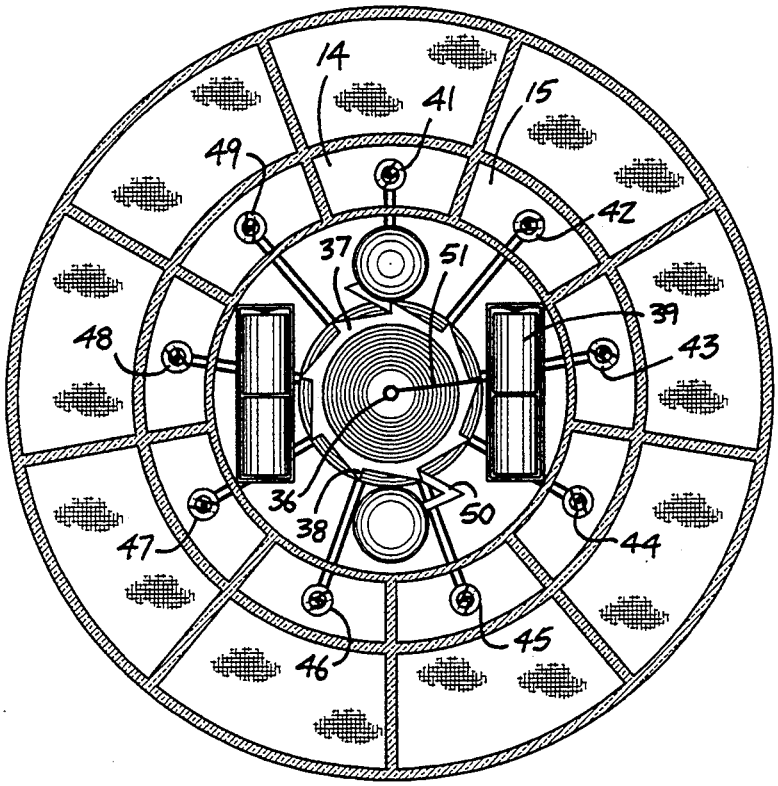
FIG. 6 is an orthographic view, taken along the lines 6—6 of FIG. 5 in the direction indicated by the arrows.
Figure 7:
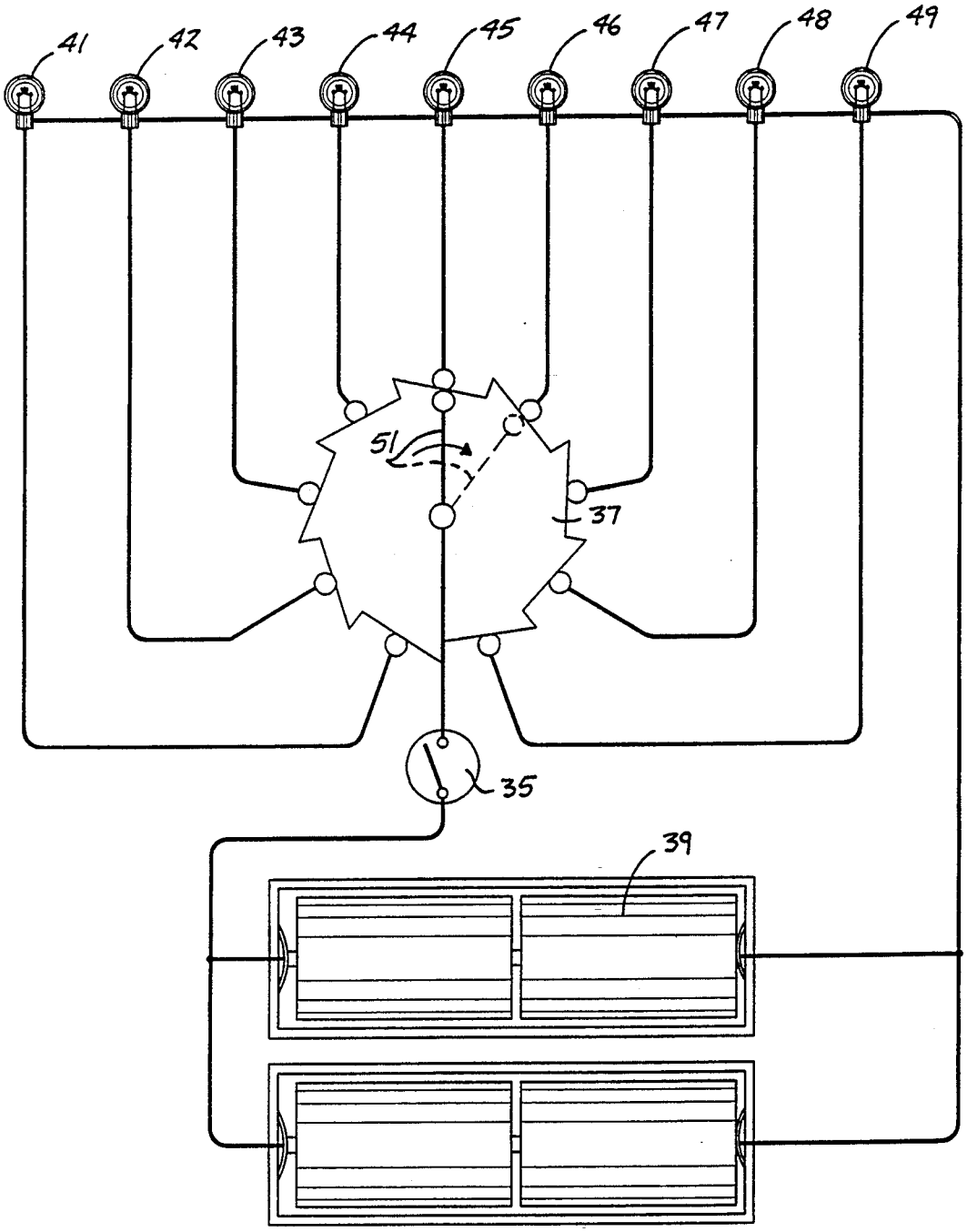
FIG. 7 is a diagrammatic illustration of the rotary switch structure employed by the game board of the invention as indicated in the FIGS. 5 and 6.

Further, the further modified game 11*b*, as indicated in FIGS. 5 and 6, includes an on/off switch 35 in electrical communication with a plurality of batteries 39. A rotating shaft 36 is directed medially and coaxially of the game board 11 extending orthogonally therethrough mounted to a rotary cylindrical switch plate 37 positioned to a bottom surface of the game board 11b, with the rotary switch plate 37 having an annular array of teeth 38 in cooperation with at least one spring leg 50 to maintain desired orientation of the switch plate 37, that includes a contact leg 51 fixedly mounted to the switch plate in electrical communication with one of a plurality of first through ninth illumination bulbs 41–49 respectively positioned below a translucent annular panel 40, whereupon selective illumination of each of the individual illumination bulbs 41–49 is positioned medially of the first through ninth playing spaces 14–22 to indicate play of such individual playing spaces for enhanced clarification in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A playing card board game apparatus for use by a plurality of players in combination with a deck of playing cards, said playing cards arranged for distribution to said players, wherein said apparatus comprises, a game board, the game board having a game board wall spaced from a game board bottom wall, and an annular array of playing spaces on said top wall, to include at least a first and a second playing space, with a central playing space medially of said annular array of said playing spaces, wherein the first and second playing spaces indicate instructions in play of a game to include said playing cards, and a plurality of chips arranged for distribution to said players, said playing spaces receiving at least one of said chips from said players, and a plurality of recessed pockets in annular array exteriorly of said annular array of playing spaces is positioned within said game board through said top wall, with a first pocket adjacent said first playing space and a second pocket adjacent said second playing space, and an on/off switch directed through said top wall in electrical communication with at least one battery mounted in adjacency to said bottom wall, and a rotary cylindrical switch plate positioned medially and coaxially of said central playing space medially of said annular array of playing spaces with said switch plate in electrical communication with said at least one battery through said on/off switch, with said switch plate having an annular array of teeth about a periphery of the switch plate, and a spring leg operatively associated with said game board in biased continuous contiguous communication with at least one of said teeth, and said annular array of playing spaces include a continuous translucent panel, a contact leg secured to the switch plate in electrical communication with said at least one battery through said on/off switch, with a first illumination bulb positioned adjacent said first playing space adjacent said game board bottom wall, and a second illumination bulb positioned adjacent said second playing space adjacent said bottom wall, wherein said rotary cylindrical switch plate includes a shaft extending fixedly to said switch plate coaxially thereof and through said top wall in rotary relationship such that upon rotating said rotary shaft and said switch plate effects displacement of said contact leg relative to and in electrical communication with said first and second illumination bulbs selectively to effect selective illumination of said first and second illumination bulb.

* * * * *